United States Patent [19]

Korte et al.

[11] Patent Number: 4,489,853

[45] Date of Patent: Dec. 25, 1984

[54] PILL DISPENSING DEVICE

[76] Inventors: Jay S. Korte, 1105 Canterbury Dr.; John E. Thees, 4599 Mud Pike, both of Celina, Ohio 45822

[21] Appl. No.: 432,668

[22] Filed: Dec. 15, 1982

[51] Int. Cl.[3] ..... B65H 3/24

[52] U.S. Cl. ..... 221/187; 221/235

[58] Field of Search ..... 221/187, 260, 232, 234, 221/235, 271, 273, 186, 190, 243

[56] References Cited

U.S. PATENT DOCUMENTS 1,321,382 11/1919 Mason ..... 221/235 X 2,493,334 1/1950 Block ..... 221/187

2,566,808 9/1951 Petty ..... 221/187

3,159,308 12/1964 Passavanti ..... 221/190 X

*Primary Examiner*—Stanley H. Tollberg

*Attorney, Agent, or Firm*—Frank B. Robb

[57] ABSTRACT

A pill dispensing device comprising a case supportable on a wrist, in which a cartridge for dispensing pills is positioned, the pills are arranged to be delivered one at a time from the cartridge through openings in a pill container, a housing and a protective cover when in alignment and by pressure of a spring member which is tensioned by longitudinal movement of the pill container.

3 Claims, 6 Drawing Figures

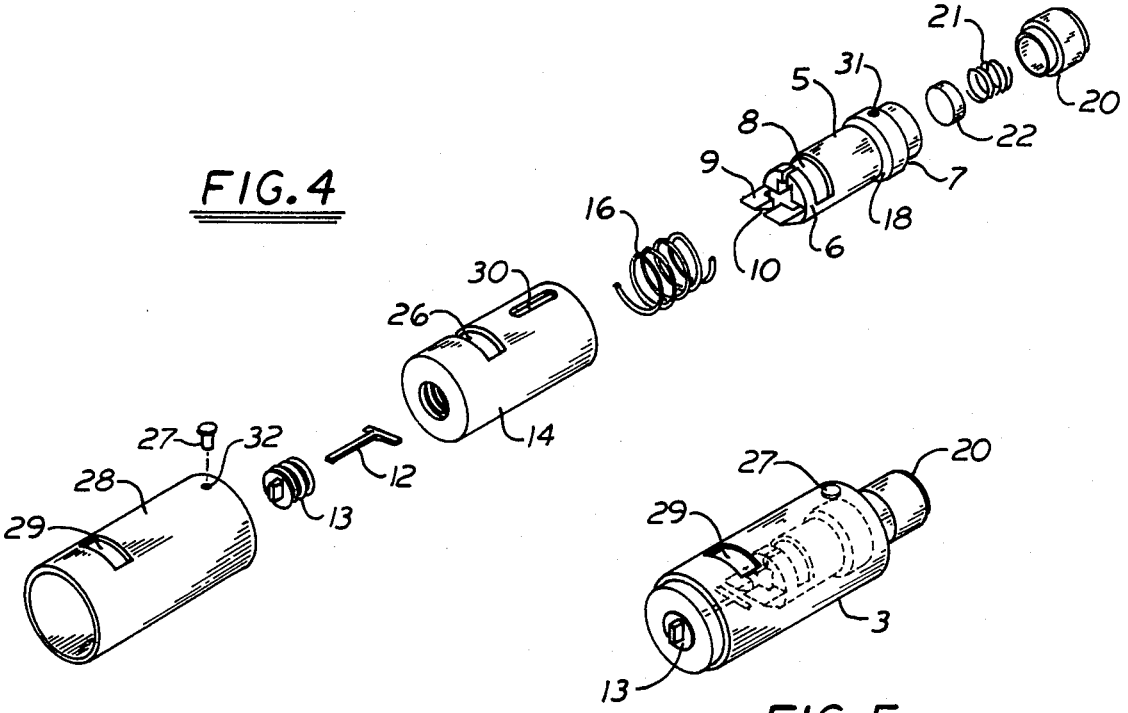
FIG. 4
FIG. 5
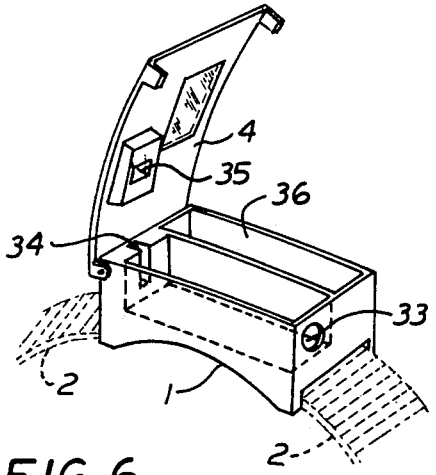
FIG. 6

PILL DISPENSING DEVICE

BACKGROUND OF THE INVENTION AND PRIOR ART

The desirability of a pill dispensing device is quite well recognized, particularly where certain timing problems are involved and where necessary to have the pills available periodically and on a regular basis without a purely automatic delivery. The concept which is revealed in this application, deals with making available pills for delivery in a sequential manner the pills being of the same or similar substantially identical size and available by suitable manipulation of a cartridge in which the said pills are contained, the cartridge desirably being small and in particularly advantageous circumstances supported in a wrist case of one kind or another which is unobtrusive and yet certainly will supply enough pills for the usual use during the daytime or when a person is not nearby a supply of pills kept in the usual types of containers.

In the prior art many such containers have been conceived wherein pills are positioned in alignment and available one at a time, some under spring pressure some not and others in open containers such as may be supported on a wrist or the like, but in any event not in a simple such arrangement as is contemplated by the inventors, which makes possible several different approaches to pill supply, that of buying them in bulk and positioning the pills one at a time in the necessary dispensing position or buying them already prepackaged and placing them in the dispensing device which is the subject of the invention.

The prior art contains such patents as that of Vreede, U.S. Pat. No. 4,171,753, Oct. 23, 1979, which discloses a holder for pills which is related to the instant invention but does not have the automatic dispensing arrangement although admittedly disclosing the columnar positioning thereof.

Innumerable other patents might be referred to but are no more pertinent than that, in the instant consideration, particularly when it is borne in mind that the concept of this invention involves unique arrangement of parts and elements which are not found in the prior art or in those references known to exist therein.

The patent of Aveni, U.S. Pat. No. 2,960,259, Nov. 15, 1960, discloses a pill container in one view which provides for the dispensing of a single pill at a time under spring pressure but again lacks the alignment of openings or the desirable attributes which the instant invention discloses.

Under the circumstances it is felt clearly proper to point out that the advance provided by the invention herein disclosed, consists in the provision of a pill container which is adapted to receive pills either in a prepackaged form or in fact one at a time and to maintain the same under spring pressure for feeding purposes. The container is intended to be reciprocated and by such reciprocation with respect to an outer housing against spring pressure is arranged to cause an ejector element to be triggered so to speak and when openings in the pill container and outer housing are in alignment the pill to be ejected therefrom.

In order to provide a suitable package, a protective cover may be supplied in which an opening is likewise formed, which when aligned with the other openings will permit the pill to be delivered. Further and finally since a wrist case is contemplated to be availed of, that likewise is provided with an opening in the cover thereof with which the various previously mentioned openings may be aligned and when suitable application of appropriate manipulation is applied to the container, the pill will be delivered one at a time therefrom.

All of the foregoing and some additional aspects of the invention are disclosed in a specification appended hereto and particularly shown in the drawings, which explain in detail the various aspects of the invention and comprise:

FIG. 1 which is a cross-sectional view through the entire device showing a pill dispensing unit in position for actuation.

FIG. 4 is an exploded view of the cartridge unit and its various elements.

FIG. 5 is a perspective view of the cartridge unit with some indication of the interior mechanism shown in dotted lines.

FIG. 6 is a perspective view of a suitable wrist case with the cartridge unit removed therefrom.

DETAILED DESCRIPTION OF THE INVENTION

Figure 1:
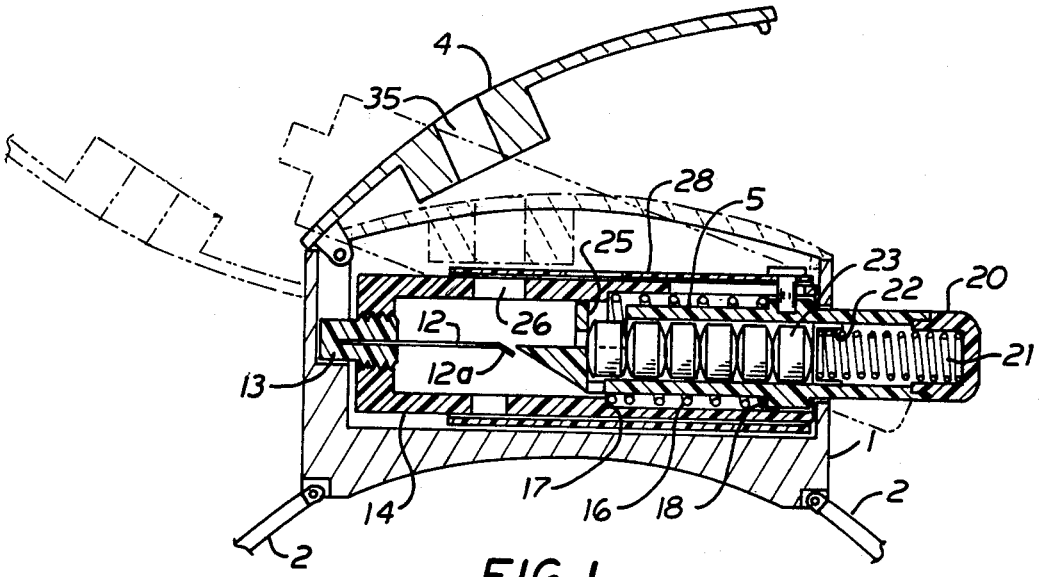

Referring to FIG. 1, the pill dispensing device of this invention comprises the wrist case 1 which may have a suitable strap connection such as 2 for wrist engagement purposes, and which is a generally rectilinear hollow member in which a compartment is provided as suggested in FIG. 6 for positioning of a cartridge unit which is the subject of FIG. 5, the cartridge unit being designated 3 and the wrist case 1 having a cover such as 4 hingedly connected thereto and adapted to close the upper opening in the wrist case 1.

Figure 3:
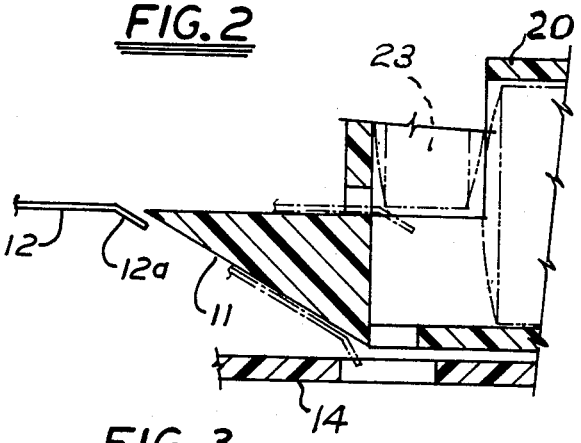
FIG. 3 is a somewhat diagrammatic view to illustrate the manner of use of the ejection mechanism.

Further details will be understood as the description progresses, and turning now to the description of the cartridge unit itself which is the subject of FIG. 5 and particularly of FIG. 4, it will be observed that basically the pill container which is designated 5, is a cylindrical somewhat elongated part, hollow, having a first end 6 and an opposite end 7 for descriptive purposes, the end 6, being provided with a transverse slot 8 through which the pills are dispensed, and being formed at that end 6 with a ramp structure 9 shown in greater detail in FIG. 3 which together with FIG. 4 will explain that the ramp structure extends outwardly beyond the end 6 and is provided with a T-shaped slot 10 therein as well as a ramp surface 11 for purposes which will appear momentarily.

At this end 6, a suitable ejector bar 12 which is also T-shaped, is positioned by means of an ejector bar positioner 13 which is threadedly engaged with an outer housing designated 14 of cylindrical nature likewise and within which the container 5 is adapted to reciprocate.

Figure 2:
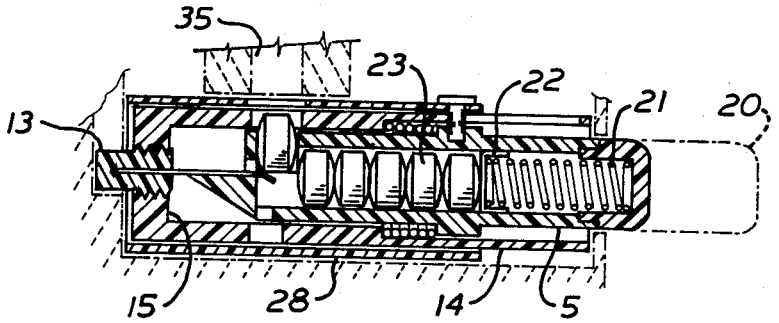
FIG. 2 is a fragmentary view showing the pill cartridge unit as though separated virtually from the rest of the mechanism and particularly leaving out the details of the wrist case and thus illustrating additionally some of the aspects and showing a pill partially delivered.

The ejector bar positioner 13 by suitable threading arrangement is positioned in the end of the housing 14 so that the ejector bar assumes the position shown in FIG. 5 as well as in FIGS. 1 and 2 particularly and even more in detail in FIG. 3, where it is prepared to be engaged by the ramp surface 11.

It should be understood that between the end 6 and the inner end wall 15 of the housing 14, a suitable spring will maintain the entire pill container usually at the extreme rightward position as shown in FIG. 1, this spring being designated 16 and engaging an abutting surface 17 in the housing 14 and a shoulder 18 on the pill container 5.

The opposite end of the pill container 5, denoted 7, is arranged with a cap 20 within which a spring 21 is confined which spring 21 in turn engages interiorally of a spring cap 22, which spring cap in its way also presses against the column of pills which pills are designated 23.

It will thus be seen that when the pills are stacked in the pill container 5, and the cap 20 applied with the spring pressure applied against the pills, that they will be positioned against the inner end or wall which is designated 25 in the pill container 5.

This will place the left most pill in the column in FIG. 1 opposite the slot or opening 8 for delivery in a manner to be subsequently described in detail.

It should be noted that by pressing on the end cap 20, the entire pill container 5 will be moved to the left with regard to the housing 14, and in so doing since the ejector element 12 is stationary, will engage said ejector element on the ramp 11 causing the end 12*a* of said element to ride down the ramp until it reaches the end of the T slot 10 and thereupon or thereafter, will spring upwardly in that T slot to the position shown in FIG. 3 as well as FIG. 2, underneath the pill which is opposite the opening 8 and thereby cause an ejection of said pill from the container.

The ramp 11 on the end 9 will be drawn back with the pill container and thus set the ejector bar or element for its next actuation to eject or deliver a pill from the opening such as 8.

It will be obvious that the next pill will be pressed into position by the spring 21 immediately and thus be ready for ejection of the pill at the end of the column thereafter It is noted that the housing 14 previously mentioned, is provided with a slot 26 which is intended to be aligned with the slot 8 so that the pill can be delivered therefrom.

In order to maintain the alignment of the pill container 5 with the outer housing 14, a suitable alignment pin 27 is availed of, which is mounted in the protective cover 28 and in turn this cover being provided with the slot 29 therein for alignment with the openings 26 and 8 of the housing and pill container 14 and 5 respectively.

This alignment pin 27 is intended to operate in a slot 30 formed in the outer housing and in turn engage with the container in an opening 31 formed therein and through the opening 32 formed in the protective cover.

The entire unit which will have at this point been formed into the unit shown in FIG. 5 and as a cartridge unit, may now be inserted in the wrist case 1 initially referred to. This is done by entering the end cap 20 through an opening 33 formed in the wrist case 1, with a vertical slot 34 provided in the interior of the wrist case to receive the end of the ejection bar positioner 13 which is provided with a flat surface to enter such slot.

Thus the entire cartridge unit will be properly positioned with the openings 8,26 and 29 uppermost for access of a pill therethrough, and this in turn is effected through a mating opening 35 formed in the cover 4 of the wrist case 1.

It will be understood that when the wrist case is closed, the opening 35 will be positioned as shown in FIG. 1 in dotted lines so that the pill may be dispensed therethrough without necessity to open the cover for that purpose and yet the pills are restrained in their position until actuation of the cap 20 takes place to move the cartridge unit or so much of the same particularly the pill container therein for purposes previously explained and with the result detailed heretofore.

It is entirely reasonable to presume that additional pills can be stored in the wrist case in a parallel storage space designated 36, and in fact may be either loose or in that storage case placed there in a container of suitable form so that the pills are columnized and available to enter into the pill container 5.

It is also contemplated that the pill container 5 may be furnished from a sanitary source without the necessity to handle the pills individually or even in small packages and then thrown away as a disposable unit when the pills are dispensed therefrom.

We claim:

1. Means for dispensing pills comprising a cartridge unit having a container for storing a quantity of pills, and means for presenting a single pill at one time for use including an ejector element which is resiliently operatively positioned by longitudinal predetermined movement of the container and causes the pill to be propelled therefrom after such movement, the aforesaid container being an elongated member in which the pills are positioned in alignment for movement toward a first end, there being a delivery opening in the container near said end, an ejector element tensioning ramp is located at said first end, the container is positioned for movement in a housing, a housing is provided for same, the ejector element is operatively located in the housing to cooperate with the ramp aforesaid, said housing having an opening therein through which a pill is delivered when the openings in the container and housing are aligned by the movement referred to and the ejector element is suddenly disengaged from the ramp after the predetermined movement aforesaid.

2. Means as claimed in claim 1, wherein, there is provided at the other end of the container means to close the same and place the aligned pills positioned therein under pressure to move toward the delivery opening, the ejector element is an elongated bar having spring qualities for tensioning and means to maintain its alignment with the ramp aforesaid during tensioning movement which is relieved at the end of such movement whereby the end of said bar will engage a single pill to effect the delivery thereof through the openings described, means being provided to return the container and housing to their respective initial positions for subsequent pill delivery action, the means for causing the pills to move being likewise availed of to effect movement of the container with respect to the housing.

3. Means for dispensing pills comprising a cartridge unit having a container for storing a quantity of pills, and means for presenting a single pill at one time for use including an ejector element which is operatively positioned by longitudinal predetermined movement of the container and causes the pill to be propelled therefrom after such movement, the aforesaid container being an elongated member in which the pills are positioned in alignment for movement toward a first end, there being a delivery opening in the container near said end, an ejector element tensioning ramp is located at said first end, the container is positioned for movement in a housing, a housing is provided for same, the ejector element is operatively located in the housing to cooperate with the ramp aforesaid, said housing having an opening therein through which a pill is delivered when the openings in the container and housing are aligned by the movement referred to, the container and housing being provided with a protective cover in which a pill delivery opening is formed and in which all pill delivery openings are subject to alignment, the container, housing and cover in turn being arranged in a carrying case having a pill delivery opening through which pills will be delivered one at a time, this aligned opening and said case providing access for the container moving means for actuation to effect such delivery.

* * * * *